US006446957B2

(12) United States Patent
Gunschera et al.

(10) Patent No.: US 6,446,957 B2
(45) Date of Patent: Sep. 10, 2002

(54) SEPARATING AID FOR A SHEET-PILE CHANGE IN A PRINTING MACHINE

(75) Inventors: Frank Gunschera, Nussloch; Uwe Fischer, Leimen, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/751,916

(22) Filed: Dec. 22, 2000

(30) Foreign Application Priority Data

Dec. 22, 1999 (DE) ..... 199 62 113

(51) Int. Cl.[7] ..... B65H 31/12
(52) U.S. Cl. ..... 271/218; 271/189
(58) Field of Search ..... 271/218, 158, 271/189; 414/790.8, 789.5

(56) References Cited

U.S. PATENT DOCUMENTS

| | | | | |
|---|---|---|---|---|
| 4,469,321 A | | 9/1984 | Geschwindner | |
| 5,002,456 A | | 3/1991 | Gösslinghoff | |
| 5,110,112 A | | 5/1992 | Henn et al. | |
| 5,116,041 A | * | 5/1992 | Pollich | 271/158 |
| 5,131,647 A | | 7/1992 | Henn et al. | |
| 5,433,429 A | | 7/1995 | Muller | |
| 5,769,413 A | * | 6/1998 | Hummel | 271/218 |

FOREIGN PATENT DOCUMENTS

| | | | |
|---|---|---|---|
| DE | 25 25 422 | * 12/1976 | 271/218 |
| DE | 39 37 945 A1 | 5/1991 | |
| DE | 40 11 286 A1 | 10/1991 | |
| DE | 43 17 357 C1 | 11/1994 | |

* cited by examiner

*Primary Examiner*—H. Grant Skaggs
(74) *Attorney, Agent, or Firm*—Laurence A. Greenberg; Werner H. Stemer; Gregory L. Mayback

(57) ABSTRACT

A device for separating a sheet pile during the running operation of a pile-forming sheet-processing machine includes a separator which, when an auxiliary pile carrier is pushed into a sheet pile to be separated, is movable between a rear upper edge of the sheet pile to be separated and a following sheet for a new sheet pile, for the purpose of lifting a rear lower edge of the new sheet pile at least into an effective range of a rear sheet stop; and a pile-forming sheet-processing machine and a pile-forming sheet-fed printing machine, respectively, including the separating device. In a device for separating a stack during the continuous operation of a stack-forming sheet-processing machine, in particular a sheet-fed printing machine, a separator (23) is provided, which, when an auxiliary stack carrier (22) is pushed in, is moved between the rear upper edge of the stack (9) to be separated and the new stack (21) formed by the following sheets (4) and which lifts the rear lower edge of the new stack (21) at least into the effective range of the rear sheet stop (15) of the stack-forming region.

10 Claims, 2 Drawing Sheets

SEPARATING AID FOR A SHEET-PILE CHANGE IN A PRINTING MACHINE

BACKGROUND OF THE INVENTION

Field of the Invention

The invention relates to a device for separating a sheet pile during a running operation of a pile-forming sheet-processing machine, in particular, a sheet-fed printing machine, and to a sheet-processing machine including the device.

In a pile-forming machine, the pile that has been produced must be removed from time to time. For a continuously operating machine, this should take place with the least possible disruption of production and without damage to any of the sheets.

For this purpose, prior to the removal of a finished pile or stack (also known as a main pile or stack), sheet catchers, which are simple separating elements, are pushed into the front region of the sheet pile, so that the next following sheet no longer descends with the leading edge thereof completely onto the main stack. Then, during the running operation, an auxiliary pile carrier in the form of a board, which is fastened to guides, is pushed into the gap that has been kept open by the sheet catchers on the front side of the pile, and carries the sheets which accumulated in the interim on the sheet catchers. The main pile, thus separated during running or continuous operation, can then be removed from the machine or be used to form so-called hurdle piles.

Due to pushing in the auxiliary pile carrier, the sheets which have accumulated on the sheet catchers may slip backward, so that a production run has to be interrupted. Particularly when the machine is operating in the hurdle mode, the problem arises that the trailing or rear-edge stops securing the pile have to be swung upwardly in order to push the boards in. The sheets lying on the sheet catchers thereby slip over the rear or trailing edge of the sheet pile, so that a neat pile can no longer be formed and, if desirable or necessary, the process has to be interrupted.

In order to prevent this from happening, in fact, a method and a device have become known heretofore, from the published German Patent Document DE 43 17 357 C1, wherein support beams and a crossbar are articulatedly connected to a traverse fastened to a sheet brake, and so-called sheet high-holders swing into the region of the pile when a pile board is pushed in. In this regard, however, the pile is fanned open by the inwardly pivoting sheet high-holders, and damage to the sheets may occur.

SUMMARY OF THE INVENTION

It is accordingly an object of the invention to provide a device of the type mentioned in the introduction hereto, which automatically prevents the sheets from slipping out of place when an auxiliary pile carrier is pushed in.

With the foregoing and other objects in view, there is provided, in accordance with one aspect of the invention, a device for separating a sheet pile during the running operation of a pile-forming sheet-processing machine, comprising a separator which, when an auxiliary pile carrier is pushed into a sheet pile to be separated, is movable between a rear upper edge of the sheet pile to be separated and a following sheet for a new sheet pile, for the purpose of lifting a rear lower edge of the new sheet pile at least into an effective range of a rear sheet stop.

In accordance with another feature of the invention, the separator is pivotable inwardly between the sheet pile to be separated and the following sheet for the new sheet pile, a rear edge of the new sheet pile being simultaneously lifted, the separator being pivotable about a horizontal axis extending transversely to a travel direction of the sheet.

In accordance with a further feature of the invention, the separating device includes a lever to which the separator is connected via a linkage, the lever being actuatable by the auxiliary pile carrier for pivoting the separator inwardly, when the auxiliary pile carrier is pushed inwardly.

In accordance with an added feature of the invention, the lever is disposed adjacent the sheet pile to be separated and the new sheet pile.

In accordance with an additional feature of the invention, the separator is disposed in the middle of a pile-forming region.

In accordance with yet another feature of the invention, the separator is actuatable counter to a restoring spring force.

In accordance with yet a further feature of the invention, the separator has at least one elongated finger for pivoting inwardly between the sheet pile to be separated and the new sheet pile, the elongated finger being formed as a lifter in a manner that, when pivoting inwardly between the sheet pile to be separated and the new sheet pile, it engages under the new sheet pile and lifts it, and in a fully pivoted-in end position, the rear new pile end lies on the separator, so as to ascend from the pushed-in auxiliary pile carrier to the rear sheet stop.

In accordance with yet an added feature of the invention, in any pivoted-in position, the separator extends obliquely to the new pile, so that, during the inwardly pivoting action, the new pile is prevented from slipping out of place by a forward-acting force component.

In accordance with yet an additional feature of the invention, the separating device includes a lever linkage via which, in addition to the separator being pivotable inwardly, the rear-edge stops are pivotable so as to make it possible for the auxiliary pile carrier to penetrate beyond the rear-edge stops, the rear edge of the new pile being secured at all times.

In accordance with another aspect of the invention, there is provided a pile-forming sheet-processing machine having a device for separating a sheet pile during the running operation of the machine, comprising a separator which, when an auxiliary pile carrier is pushed into a sheet pile to be separated, is movable between a rear upper edge of the sheet pile to be separated and a following sheet for a new sheet pile, for the purpose of lifting a rear lower edge of the new sheet pile at least into an effective range of a rear sheet stop.

In accordance with a concomitant feature of the invention, there is provided a pile-forming sheet-fed printing machine having a device for separating a sheet pile during the running operation of the machine, comprising a separator which, when an auxiliary pile carrier is pushed into a sheet pile to be separated, is movable between a rear upper edge of the sheet pile to be separated and a following sheet for a new sheet pile, for the purpose of lifting a rear lower edge of the new sheet pile at least into an effective range of a rear sheet stop.

In the device according to the invention and in the sheet-processing machine and sheet-fed printing press according to the invention, the aforementioned object of the invention is achieved in that a separator is provided, which, when an auxiliary pile carrier is pushed inwardly, is moved between a rear upper edge of the sheet pile to be separated and a new sheet pile formed by following sheets and which lifts the rear lower edge of the new pile at least into the effective range of the rear sheet stop of the pile-forming region.

For this purpose, provision may be made for the separator to be pivotable from below about a horizontal axis running transversely to the sheet running direction, inwardly between the pile to be separated and the new pile, the rear edge of the new pile being simultaneously lifted.

In order to actuate the separator automatically when the auxiliary pile carrier is pushed inwardly, provision may be made for the separator to be connected via a linkage to a lever which, when the auxiliary pile carrier is pushed inwardly, is actuated by the latter and pivots in the separator.

So as not to obstruct the piles, provision is made for the lever to be arranged adjacent the piles.

In a further development of the invention, provision is made for the separator to be arranged in the middle of a pile-forming region.

In order to avoid damage to the rear edge of the new pile when the auxiliary pile carrier is lowered, provision may, furthermore, be made for the separator to be actuated counter to a restoring spring force.

In another development of the invention, there is provision for the separator to have, for pivoting inwardly between the piles, at least one elongated finger formed like a lifter, so that, when pivoted into the pile-forming region, it engages under the new pile and lifts it, and, in a fully pivoted-in end position, the rear pile end lies on the separator so as to ascend from the pushed-in auxiliary pile carrier to the rear sheet stop.

In order to prevent the new pile from slipping out of place when the auxiliary pile carrier is pushed in, in a further development there is a provision, the in each pivoting-in position, the separator extends obliquely to the new pile, so that, during the inwardly pivoting action, the new pile is prevented from slipping out of place by a forward-acting force component.

Furthermore, in a development of the invention, via a lever linkage, in addition to the separator being pivoted inwardly, the rear-edge stops are pivoted away so that it is possible for the auxiliary pile carrier to penetrate past the rear-edge stops, the rear edge of the new pile being secured at all times.

Other features which are considered as characteristic for the invention are set forth in the appended claims.

Although the invention is illustrated and described herein as embodied in a separating aid for a sheet-pile change in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

Identical parts have like reference numerals in all of the figures.

DESCRIPTION OF THE PREFERRED EMBODIMENTS

Figure 1:
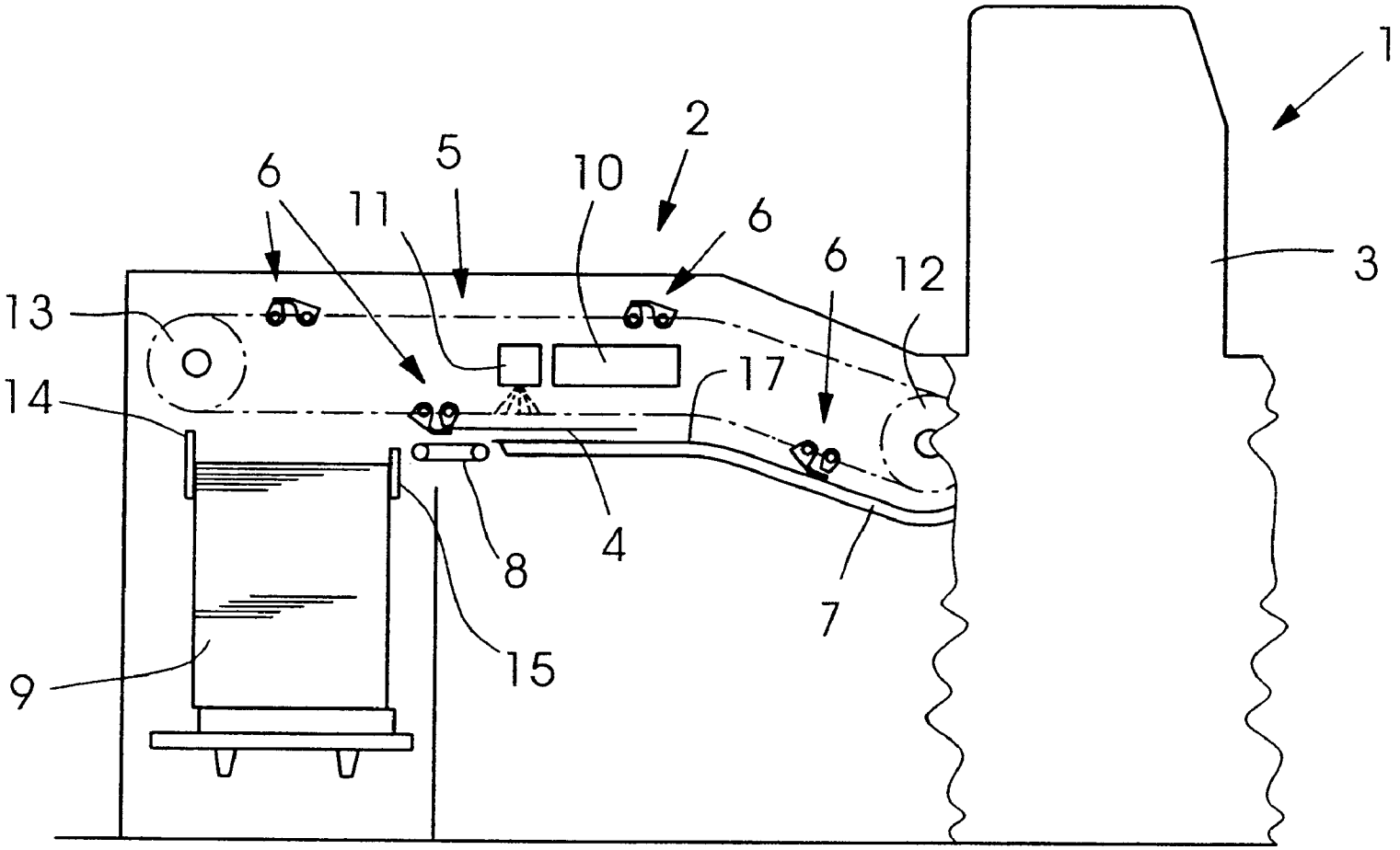
FIG. 1 is a fragmentary diagrammatic side elevational view of a sheet-fed printing machine wherein the separating aid or separator according to the invention can be incorporated.

Referring now to the drawings and, first, particularly to FIG. 1 thereof, there is shown therein a sheet-fed printing machine 1 wherein a last printing unit 3 is followed by a delivery 2. Printed sheets 4 are picked up from the last printing unit 3 by gripper systems 6 fastened to chains 5, shown only in phantom here, and are transported via a sheet guide device 7 and a sheet brake 8 onto a main sheet pile or stack 9 and deposited thereon. In order to prevent the sheets from sticking to the main sheet pile 9 while they are being deposited, the sheets are conveyed under a dryer 10 and past a dusting or powdering device 11.

One of the chains 5, respectively, runs over a driving sprocket wheel 12 and a deflecting or reversing region 13 and is guided in non-illustrated chain guide paths.

A sheet 4 which is to be deposited is dragged or forwarded onto the sheet brake 8 by the gripper systems 6. After the sheet 4 has been released from the gripper systems 6, it is braked by the sheet brake 8, which is shown in FIG. 1 as a suction belt and, finally, the sheet 4 slides against a front sheet stop 14 and descends with the trailing edge thereof past a rear sheet stop 15 onto the main pile 9. The main pile 9 is simultaneously moved downwardly in order to compensate for the increase in height thereof resulting from the deposit of this sheet 4.

Figure 2:
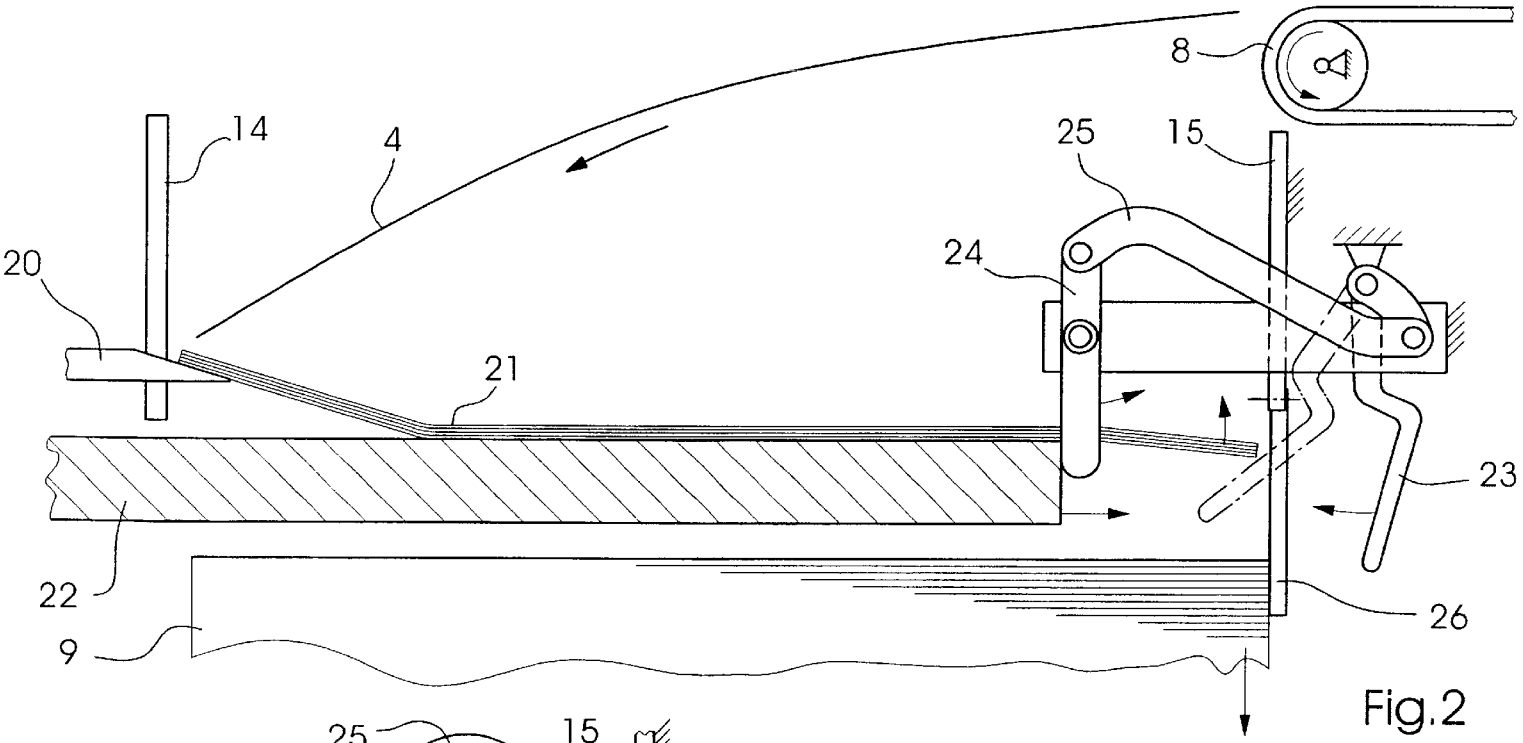
FIG. 2 is a diagrammatic side elevational view of the separator according to the invention in an operating phase thereof before an inwardly pivoting action.

In order to remove a sheet pile when the machine is in running operation, i.e., operating continuously, sheet catchers 20 are pushed into the pile-forming region from the front, as shown in FIG. 2. The following sheets 4, which form a new pile 21, are caught by the leading edge thereof on the sheet catchers 20 and remain hanging thereon. An auxiliary pile carrier 22 running on non-illustrated guides is pushed into the gap which is thereby formed on the front side of the pile-forming region.

So that the new pile 21 does not slip backwards when the auxiliary stack carrier 22 is pushed in completely, a separator 23 is provided, which is pivoted between the main pile 9 and the new pile 21, via a slide linkage 25, by a lever 24 actuated by the auxiliary pile carrier 22, and, simultaneously, supports the new pile and lifts it at the rear lower edge thereof, into the effective range of the rear sheet stop 15. The non-identified arrows indicate the movements of the individual parts with which they are shown associated. Rear-edge stops 26 can be swung away so that it is possible for the auxiliary pile carrier 22 to pass through, the rear edge of the main pile 9 and of the new pile 21 being secured at all times.

Figure 3:
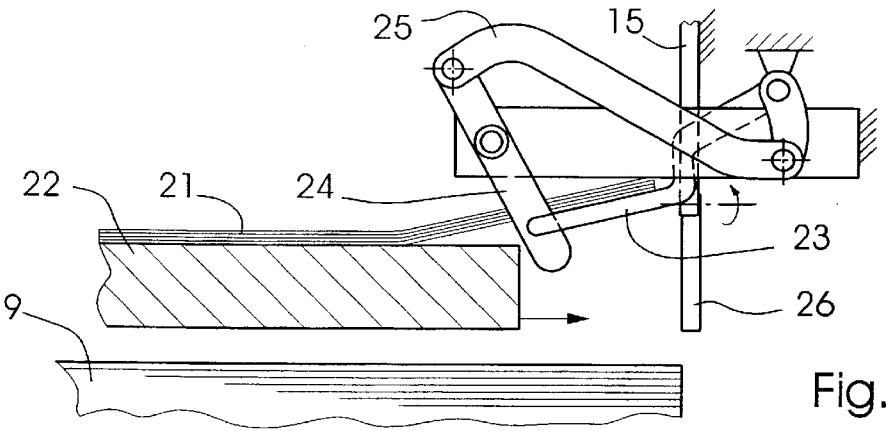
FIG. 3 is a fragmentary view of the separator of FIG. 2, in an operating phase thereof after the inwardly pivoting action.

FIG. 3 shows the separator 23 in an operating phase wherein it is pivoted inwardly almost completely. The auxiliary pile carrier 22 can then be pushed in completely.

We claim:

1. A device for separating a sheet pile during the running operation of a pile-forming sheet-processing machine, comprising:

a rear sheet stop;

an auxiliary pile carrier; and a separator which, when said auxiliary pile carrier is pushed towards said rear sheet stop above a topmost sheet of the sheet pile to be separated, is inserted between a rear upper edge of the sheet pile to be separated and a following sheet for a new sheet pile, lifting a rear lower edge of the new sheet pile at least to a height in which said rear sheet stop has an effect on the new sheet pile.

2. The device according to claim 1, wherein said separator is pivotable inwardly between the sheet pile to be separated and the following sheet for the new sheet pile, a rear lower edge of said new sheet pile being simultaneously lifted, said separator being pivotable about a horizontal axis extending transversely to a travel direction of the sheet.

3. The device according to claim 2, including a lever to which said separator is connected via a linkage, said lever being actuatable by said auxiliary pile carrier for pivoting said separator inwardly, when said auxiliary pile carrier is pushed towards said rear sheet stop.

4. The device according to claim 3, wherein said lever is disposed adjacent the sheet pile to be separated and the new sheet pile.

5. The device according to claim 1, wherein said separator is disposed in the middle of a pile-forming region.

6. The device according to claim 1, wherein said separator has at least one elongated finger adapted for pivoting inwardly between the sheet pile to be separated and the new sheet pile, said elongated finger being formed as a lifter in a manner that, when pivoting inwardly between the sheet pile to be separated and the new sheet pile, it engages under the new sheet pile and lifts it, and in a fully pivoted-in end position, the rear new pile end lies on said separator, so as to ascend from said auxiliary pile carrier pushed towards said rear sheet stop.

7. The device according to claim 6, wherein, in any pivoted-in position, said separator extends obliquely to the new pile, so that, when pivoting said separator, the new pile is prevented from slipping out of place by a forward-acting force component.

8. The device according to claim 1, including pivotable rear-edge stops allowing said auxiliary pile carrier to penetrate beyond said rear-edge stops, while the rear lower edge of the new pile is secured by said separator and said rear sheet stop.

9. A pile-forming sheet-processing machine having a device for separating a sheet pile during the running operation of the machine, comprising:

a rear sheet stop;

an auxiliary pile carrier; and a separator which, when said auxiliary pile carrier is pushed towards said rear sheet stop above a topmost sheet of the sheet pile to be separated, is inserted between a rear upper edge of the sheet pile to be separated and a following sheet for a new sheet pile, lifting a rear lower edge of the new sheet pile at least to a height in which said rear sheet stop has an effect on the new sheet pile.

10. A pile-forming sheet-fed printing machine having a device for separating a sheet pile during the running operation of the machine, comprising:

a rear sheet stop;

an auxiliary pile carrier; and a separator which, when said auxiliary pile carrier is pushed towards said rear sheet stop above a topmost sheet of the sheet pile to be separated, is inserted between a rear upper edge of the sheet pile to be separated and a following sheet for a new sheet pile, lifting a rear lower edge of the new sheet pile at least to a height in which said rear sheet stop has an effect on the new sheet pile.

* * * * *